US005364198A

United States Patent [19]

Skenderi

[11] Patent Number: 5,364,198

[45] Date of Patent: Nov. 15, 1994

[54] SELF CONTAINED WINDOW CLEANING IMPLEMENT

[76] Inventor: Sabaudin Skenderi, 475 Lincoln Ave., Wyckoff, N.J. 07481

[21] Appl. No.: 68,858

[22] Filed: May 28, 1993

[51] Int. Cl.[5] ..... A47L 1/08

[52] U.S. Cl. ..... 401/138; 401/140; 401/146

[58] Field of Search ..... 401/146, 149, 150, 138, 401/140

[56] References Cited

U.S. PATENT DOCUMENTS

| | | | |
|---|---|---|---|
| 419,871 | 1/1890 | Orcutt | 401/138 |
| 1,091,888 | 3/1914 | Lurzing | 401/140 X |
| 1,783,506 | 12/1930 | Homiller | 401/139 |
| 2,497,674 | 2/1950 | Kolchinsky | 401/139 |
| 2,768,401 | 10/1956 | Becker et al. | 401/138 X |
| 3,377,123 | 4/1968 | Leeson | 401/139 |
| 3,457,016 | 7/1969 | Gotberg | 401/138 X |
| 4,640,638 | 2/1987 | Bokmiller et al. | 401/146 X |
| 4,778,298 | 10/1988 | Shin et al. | 401/146 X |

FOREIGN PATENT DOCUMENTS

| | | | |
|---|---|---|---|
| 176249 | 10/1906 | Germany | 401/139 |
| 1934380 | 1/1970 | Germany | 401/138 |
| 571834 | 6/1958 | Italy | 401/138 |
| 23100 | 10/1908 | United Kingdom | 401/139 |

*Primary Examiner*—Steven A. Bratlie
*Attorney, Agent, or Firm*—Rhodes & Ascolillo

[57] ABSTRACT

A self contained window cleaning implement, the window cleaning implement including an elongated handle member, a squeegee member located on one end of the elongated handle member, a spray nozzle for dispensing a spray, the spray nozzle being located on the one end of the elongated handle member adjacent the squeegee member, the squeegee member extending at an oblique angle outward and downward from the elongated handle member, and the spray apparatus being located above the squeegee member, a reservoir for holding a supply of a cleaning fluid, the reservoir being attached to the other end of the elongated handle member opposite the one end of the handle member, a tube extending from the reservoir to the spray nozzle for transferring the cleaning fluid from the reservoir to the spray nozzle, and a manually actuable pump apparatus for forcing the cleaning fluid from the reservoir, through the tube, and to the spray nozzle, the manually actuable pump apparatus being located on the other end of the elongated handle member, and the manually actuable pump apparatus including a digitally depressible trigger member.

6 Claims, 3 Drawing Sheets

SELF CONTAINED WINDOW CLEANING IMPLEMENT

BACKGROUND

1. Field of the Invention

The present invention relates to the field of window cleaning tools.

2. Description of the Related Art

U.S. Pat. No. 4,871,275 relates to an extended window cleaning tool having preferably a pair of squeegee blades and an abrasive pad positioned therebetween. The abrasive pad can be shifted outward beyond the squeegee blades by a bladder that also supplies a cleaning solution to the pad. The bladder is supplied solution from a separate pressurized reservoir.

U.S. Pat. No. 5,054,945 relates to a window cleaning device that is particularly adapted for motorists, and which includes a plastic bottle having both a sponge and a squeegee extending along the length of the bottle, a cleaning solution from the bottle being supplied to the sponge through a small valve in the sidewall of the bottle.

U.S. Pat. No. 3,724,017 discloses a now popular type of automotive window cleaning implement having a short wooden handle, on one end of which there is provided both a squeegee and a sponge element which extend from the handle in opposite directions. The durability of the sponge element is said to be improved by covering it with a net that is interposed between the sponge element and the handle.

U.S. Pat. No. 4,910,825 relates to a handle mounted squeegee having a liquid retentive pad resiliently mounted to the squeegee.

U.S. Pat. Des. No. 305,868 shows a design for a combined spray pump dispenser and squeegee for cleaning windshields.

SUMMARY OF THE INVENTION

In one aspect, the invention generally features a self contained window cleaning implement, the window cleaning implement including: an elongated handle member; a squeegee member disposed on one end of the elongated handle member; a spray apparatus for dispensing a spray, the spray apparatus being disposed on the one end of the elongated handle member adjacent the squeegee member; a reservoir for holding a supply of a cleaning fluid, the reservoir being attached to the other end of the elongated handle member opposite the one end of the handle member; a fluid passageway for transferring the cleaning fluid from the reservoir to the spray apparatus; and a fluid pump apparatus for forcing the cleaning fluid from the reservoir, through the fluid passageway, and to the spray apparatus, the fluid pump apparatus being disposed on the other end of the elongated handle member.

Preferably, the fluid pump apparatus includes a manually actuable pump apparatus; the squeegee member extends at an oblique angle outward and downward from the elongated handle member, and the spray apparatus is disposed above the squeegee member; the manually actuable pump apparatus includes a digitally depressible trigger member; the digitally depressible trigger member extends outward from the elongated handle member; the fluid passageway includes a tube extending from the reservoir to the spray apparatus; the tube is disposed in a spiral fashion about the handle member; the spray apparatus includes a spray nozzle; the handle member includes a telescoping handle apparatus for extending to a plurality of lengths; the telescoping handle apparatus includes a first tubular member and a second tubular member, the first tubular member being slidingly disposed within the second tubular member, and the telescoping handle apparatus additionally includes a locking apparatus for locking the first and second tubular members in a plurality of relative axial positionings; and the locking apparatus includes a rotatable locking nut.

In another aspect, the invention generally features a self contained window cleaning implement, the window cleaning implement including: an elongated handle member; a squeegee member disposed on one end of the elongated handle member; a spray nozzle for dispensing a spray, the spray nozzle being disposed on the one end of the elongated handle member adjacent the squeegee member; the squeegee member extending at an oblique angle outward and downward from the elongated handle member, and the spray apparatus being disposed above the squeegee member; a reservoir for holding a supply of a cleaning fluid, the reservoir being attached to the other end of the elongated handle member opposite the one end of the handle member; a tube extending from the reservoir to the spray nozzle for transferring the cleaning fluid from the reservoir to the spray nozzle; and a manually actuable pump apparatus for forcing the cleaning fluid from the reservoir, through the tube, and to the spray nozzle, the manually actuable pump apparatus being disposed on the other end of the elongated handle member; and the manually actuable pump apparatus including a digitally depressible trigger member.

Preferably, the handle member includes a telescoping handle apparatus for extending to a plurality of lengths; the telescoping handle apparatus includes a first tubular member and a second tubular member, the first tubular member being slidingly disposed within the second tubular member, and the telescoping handle apparatus additionally includes a locking apparatus for locking the first and second tubular members in a plurality of relative axial positionings; and the locking apparatus includes a rotatable locking nut;

In yet another aspect, the invention generally features a self contained window cleaning implement, the window cleaning implement including: an elongated handle member; a squeegee member disposed on one end of the elongated handle member; a spray nozzle for dispensing a spray, the spray nozzle being disposed on the one end of the elongated handle member adjacent the squeegee member; the squeegee member extending at an oblique angle outward and downward from the elongated handle member; the spray nozzle being disposed above the squeegee member; a reservoir for holding a supply of a cleaning fluid, the reservoir being attached to the other end of the elongated handle member opposite the one end of the handle member; a tube extending from the reservoir to the spray nozzle for transferring the cleaning fluid from the reservoir to the spray nozzle, the tube being disposed in a spiral fashion about the handle member; and a manually actuable pump apparatus for forcing the cleaning fluid from the reservoir, through the tube, and to the spray nozzle, the manually actuable pump apparatus being attached to the other end of the elongated handle member; the manually actuable pump apparatus including a digitally depressible trigger member, the digitally depressible trigger member extending outward from the elongated handle member; the elongated handle member including telescoping handle apparatus, the telescoping handle apparatus including a first tubular member and a second tubular member, the first tubular member being slidingly disposed within the second tubular member; the telescoping handle apparatus additionally including a locking apparatus for locking the first and second tubular members in a plurality of relative axial positionings; and the locking apparatus including a rotatable locking nut.

One object of the present invention is the provision of a window cleaning implement that makes it possible to clean a window without repeatedly switching tools.

Another object of the invention is the provision of such a window cleaning implement that permits the user to maintain a comfortable and healthy posture.

A still further object of the invention is the provision of a window cleaning implement that is suitable for either extremely large or elevated windows.

The invention will now be described by way of a particularly preferred embodiment, reference being made to the accompanying drawings, wherein:

DESCRIPTION OF THE PREFERRED EMBODIMENT

Figure 1:
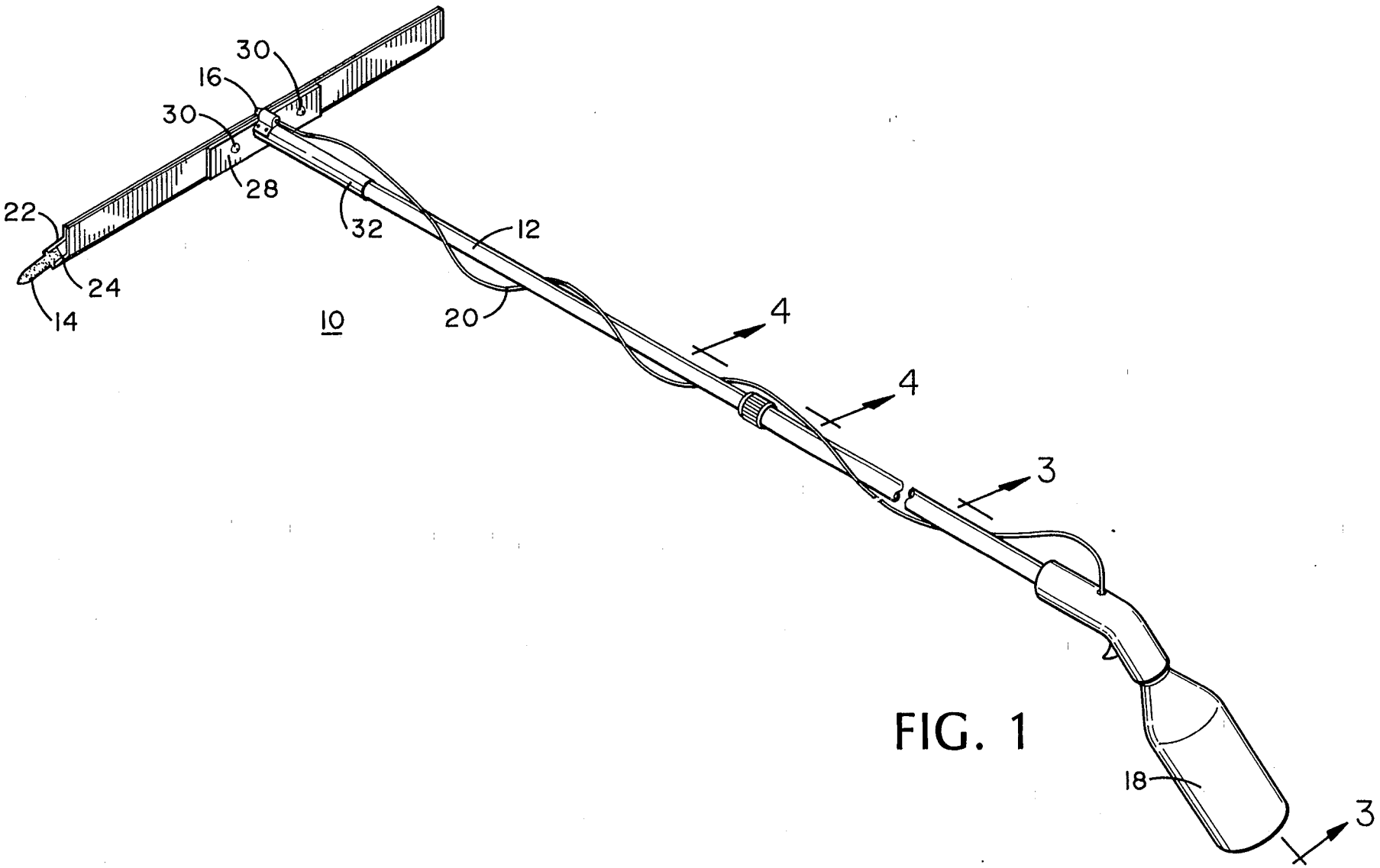
FIG. 1 is a perspective view of a window cleaning implement constructed according to the present invention.

Referring now most particularly to FIG. 1, a window cleaning implement 10 constructed according to the present invention generally includes an elongated handle 12, a squeegee 14 located at one end of the handle 12, a spray device 16 also located at the same end of the handle as the squeegee 14, and a cleaning fluid reservoir bottle 18 located at the other end of the handle 12. Additionally, a fluid passageway 20 interconnects the spray device 16 with the cleaning fluid reservoir bottle 18. Preferably, the fluid passageway 20 is a tube that is wound, in a spiral fashion, about the handle 12.

Figures 2, 3, 4:
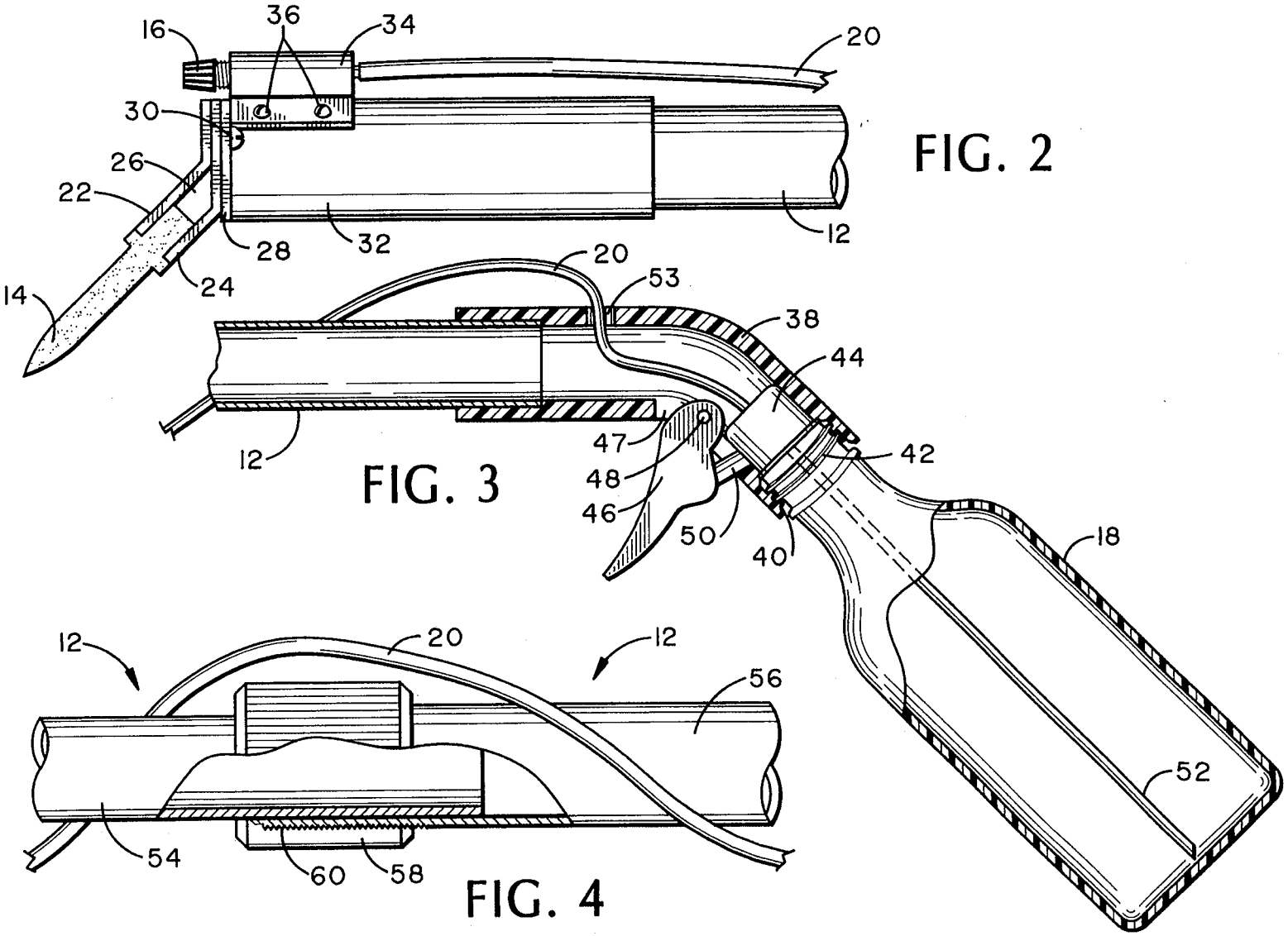
FIG. 2 is a partially sectional view of a spray device and a squeegee member provided at one end of the window cleaning implement of FIG. 1.
FIG. 3 is a partially sectional view of a cleaning fluid reservoir and a fluid pump provided at the other end of the inventive window cleaning implement.
FIG. 4 is a partially sectional view of a telescoping and locking assembly of the inventive window cleaning implement.

Referring now most particularly to FIGS. 1 and 2, the one end of the handle 12 is preferably provided with a pair of cross pieces 22 and 24 that extend transversely (preferably at a right angle) to the longitudinal axis of the handle 12, each of the cross pieces 22 and 24 having an doglegged cross section, as is shown most clearly in FIG. 2. The upright or vertical leg portions of the two cross pieces lay flush against one another, while the angled leg portions thereof form a channel 26 that extends obliquely outward and downward from the handle 12, in which channel 26 the squeegee 14 is mounted. The two cross pieces 22 and 24 are secured to a shorter cross piece 28 by a pair of screws 30, the shorter cross piece 28 being preferably formed integrally with a short tubular member 32 that fits snugly over the one end of the handle 12.

The spray device 16, which is preferably a conventional spray nozzle of the well known variety, is preferably positioned above the squeegee 14, and is mounted there through the provision of a semicircular mounting bracket 34 that partially surrounds the spray device 16 and which is attached to the tubular member 32 by another pair of screws 36.

Referring now to FIG. 3, the cleaning fluid reservoir bottle 18 is attached to the other end of the handle 12 through the provision of a tubular gooseneck member 38, which, at one end thereof, is frictionally fit to the handle 12 and, at the other end thereof, is provided with a threaded female fitting 40 for threadingly engaging a threaded male fitting 42 provided on the reservoir bottle 18. A fluid pump 44, of a conventional type that is well known, is provided for forcing the cleaning fluid from the reservoir bottle 18 into and through the fluid passageway 20, to exit at the spray device 16. The fluid pump 44 has a trigger 46 that extends outward from the handle 12 and that is depressible by a finger (e.g., a forefinger) of a user. The trigger 46 is positioned within a slot 47 provided in the gooseneck member 38, is pivotally attached there to the gooseneck member 38 via a pivot pin 48, and is connected to the fluid pump 44 by a push rod 50 that actuates the fluid pump 44. The fluid passageway (or tube) 20 either extends into the reservoir bottle 18 or, preferably, is connected to a siphon tube 52 that extends downward to a point near the bottom of the reservoir bottle 18. The fluid passageway 20 preferably exits the fluid pump 44 within the gooseneck member 38 and, thereafter, passes through an aperture 53 provided therein.

Figure 5:
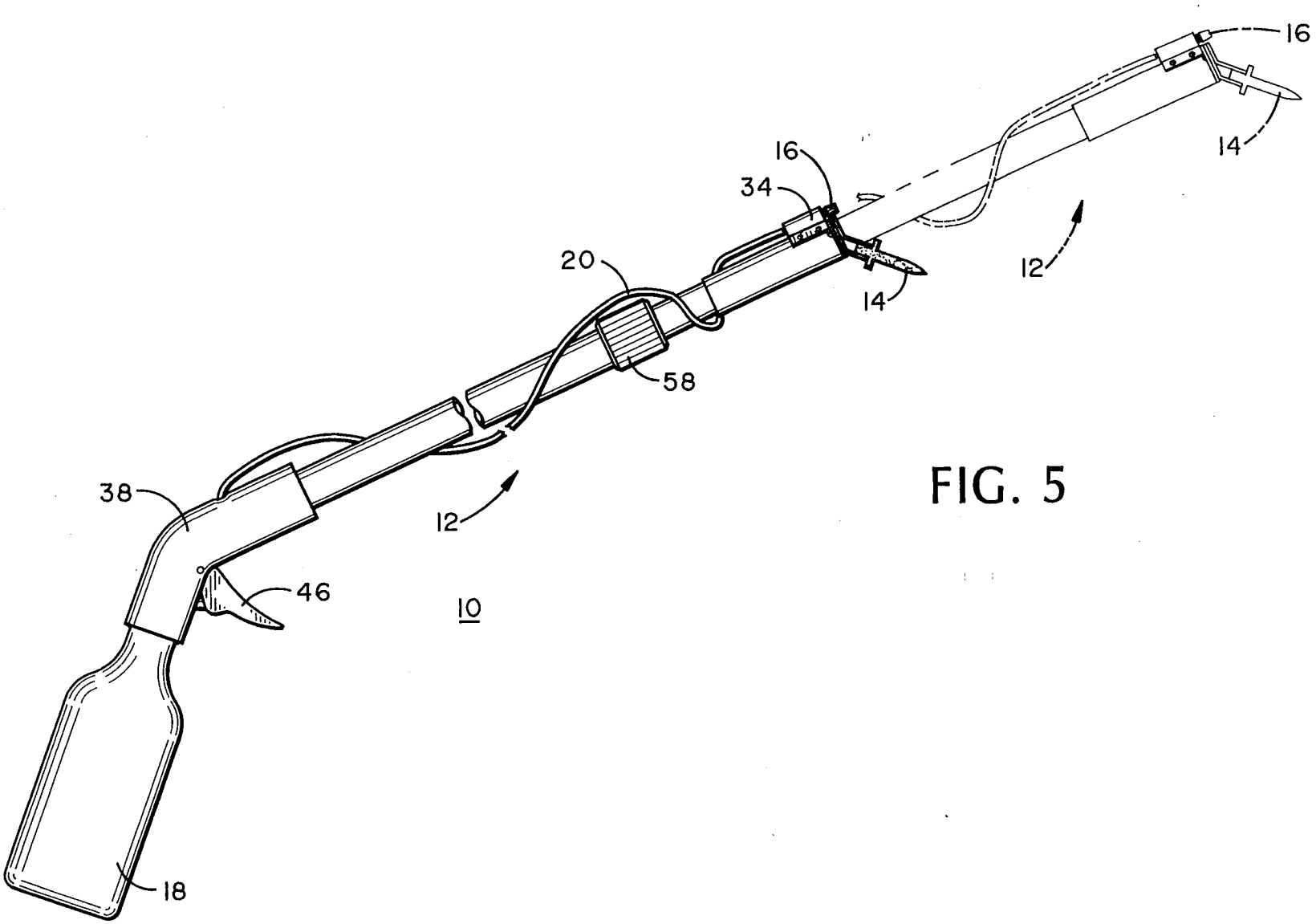
FIG. 5 is another perspective view of the inventive window cleaning implement, illustrating a telescoping feature thereof.

Referring now most particularly to FIGS. 4 and 5, in a particularly preferred embodiment of the invention, the handle 12 is telescopically extendable and retractable and, to this end, is constructed of a pair of telescoping tubular members 54 and 56. The outside diameter of the tubular member 54 is substantially equal to the inside diameter of the tubular member 56, thereby allowing the tubular member 54 to be slidingly positioned within the tubular member 56. A locknut 58 is positioned adjacent the interior end of the tubular member 56 and is threadingly engaged with the outside surface thereof via threads 60. As shown in FIG. 5, by loosening the locknut 58, the tubular members 54 and 56 may be slidingly extended or retracted relative to one another to produce a handle 12 of a plurality of lengths, at which time the locknut 58 may again be tightened to enable use of the window cleaning implement 10.

While the invention has been herein described by way of a particular preferred embodiment, various substitutions of equivalents may be effected without departing from the spirit and scope of the invention as set forth in the following claims.

What is claimed is:

1. A self contained window cleaning implement, said window cleaning implement comprising:

an elongated handle member;

a squeegee member disposed on one end of said elongated handle member;

spray means for dispensing a spray, said spray means being disposed on said one end of said elongated handle member adjacent said squeegee member;

said squeegee member extending at an oblique angle downward from said elongated handle member, wherein said spray means is disposed above said squeegee member;

a cleaning fluid reservoir for holding a supply of a cleaning fluid, said cleaning fluid reservoir being attached to the other end of said elongated handle member opposite said one end of said handle member;

a fluid passageway for transferring the cleaning fluid from said cleaning fluid reservoir, to said spray means;

said fluid passageway comprising a tube extending from said cleaning fluid reservoir to said spray means, wherein said tube is disposed in a spiral fashion about said handle member;

fluid pump means for forcing the cleaning fluid from said cleaning fluid reservoir, through said fluid passageway and to said spray means, said fluid pump means being disposed on said other end of said elongated handle member;

said fluid pump means comprising manually actuable pump means, said manually actuable pump means further comprising a digitally depressable trigger member, said digitally depressable trigger member extending outward from said elongated handle member.

2. A self contained window cleaning implement according to claim 1, wherein said spray means comprises a spray nozzle.

3. A self contained window cleaning implement according to claim 2, wherein said handle member comprises telescoping handle means for extending to a plurality of lengths.

4. A self contained window cleaning implement according to claim 3, wherein said telescoping handle means comprises a first tubular member and a second tubular member, said first tubular member being slidingly disposed within said second tubular member, and wherein said telescoping handle means additionally comprises locking means for locking said first and second tubular members in a plurality of relative axial positionings.

5. A self contained window cleaning implement according to claim 4, wherein said locking means comprises a rotatable locking nut.

6. A self contained window cleaning implement, said window cleaning implement comprising:

an elongated handle member;

a squeegee member disposed on one end of said elongated handle member, a spray nozzle for dispensing a spray, said spray nozzle being disposed on said one end of said elongated handle member adjacent said squeegee member;

said squeegee member extending at an oblique angle outward and downward from said elongated handle member;

said spray nozzle being disposed above said squeegee member;

a cleaning fluid reservoir for holding a supply of a cleaning fluid, said cleaning fluid reservoir being attached to the other end of said elongated handle member opposite said one end of said handle member;

a tube extending from said cleaning fluid reservoir to said spray nozzle for transferring the cleaning fluid from said cleaning fluid reservoir to said spray nozzle, said tube being disposed in a spiral fashion about said elongated handle member; and manually actuable pump means for forcing the cleaning fluid from said cleaning fluid reservoir, through said tube, and to said spray nozzle, said manually actuable pump means being attached to said other end of said elongated handle member;

said manually actuable pump means comprising a digitally depressible trigger member, said digitally depressible trigger member extending outward from said elongated handle member; and a telescoping handle means, said telescoping handle means comprising a first tubular member and a second tubular member, said first tubular member being slidingly opposed within said second tubular member, and said telescoping handle means additionally comprising locking means for locking said first and second tubular members in a plurality of relative axial positionings;

said locking means comprising a rotatable locking nut.

* * * * *